US009314095B2

(12) United States Patent
Hwang et al.

(10) Patent No.: US 9,314,095 B2
(45) Date of Patent: Apr. 19, 2016

(54) HAIRDRESSING DEVICE HAVING GEAR MODULE FOR REDUCING ROTATIONAL SPEED

(71) Applicant: AMOREPACIFIC CORPORATION, Seoul (KR)

(72) Inventors: Cheonghwan Hwang, Seoul (KR); Hyeseong Nam, Seoul (KR); Wooram Park, Seoul (KR); So-hee Kim, Seoul (KR); Yoonhee Lee, Seoul (KR)

(73) Assignee: AMOREPACIFIC CORPORATION, Yongsan-Gu, Seoul (KR)

( * ) Notice: Subject to any disclaimer, the term of this patent is extended or adjusted under 35 U.S.C. 154(b) by 0 days.

(21) Appl. No.: 14/410,039

(22) PCT Filed: May 29, 2013

(86) PCT No.: PCT/KR2013/004681

§ 371 (c)(1),
(2) Date: Dec. 19, 2014

(87) PCT Pub. No.: WO2013/191389

PCT Pub. Date: Dec. 27, 2013

(65) Prior Publication Data

US 2015/0189980 A1 Jul. 9, 2015

(30) Foreign Application Priority Data

Jun. 20, 2012 (KR) ..... 10-2012-0065908

(51) Int. Cl.
*A46B 13/02* (2006.01)
*A61H 7/00* (2006.01)
(Continued)

(52) U.S. Cl.
CPC ..... *A46B 13/008* (2013.01); *A45D 34/042* (2013.01); *A46B 13/02* (2013.01);
(Continued)

(58) Field of Classification Search
CPC ..... A61H 7/003; A61H 7/005; A61H 2201/1671; A61H 2201/1462; A61H 2201/1215; A61H 2201/0153; A61H 2205/022; A47K 7/043; A46B 13/00; A46B 13/008; A46B 13/02; A46B 7/08; A46B 15/001; A46B 15/0038; A46B 2200/1006; A46B 2200/102; A45D 2200/1065; A45D 2200/1063; A46D 1/02; A46D 1/023
USPC ..... 15/28, 97.1; 601/114
See application file for complete search history.

(56) References Cited

U.S. PATENT DOCUMENTS 3,027,585 A * 4/1962 Freedman ..... A47J 43/06 15/230.19
4,203,431 A * 5/1980 Abura ..... A61H 7/005 15/28

(Continued)

FOREIGN PATENT DOCUMENTS

GB 2323026 * 9/1998
KR 10-2004-0108540 A 12/2004

(Continued)

*Primary Examiner* — Mark Spisich
(74) *Attorney, Agent, or Firm* — East West Law Group; Heedong Chae

(57) ABSTRACT

Provided is a makeup device having a gear module for reducing rotational speed. The makeup device includes: a case module including a first case and a second case detachably attached to the first case; a power supply provided in the case module; a rotary motor electrically connected to the power supply and provided in the case module; a gear module connected to a driving shaft of the rotary shaft to reduce rotational speed of the rotary motor; a brush plate exposed out of the first case and reduced to rotate by a gear ratio of the rotary module and mounted with a brush; and a controller positioned in the case module and controlling rotational speed of the brush plate according to an operation of the switch.

6 Claims, 5 Drawing Sheets

(51) Int. Cl.

| | |
|---|---|
| ***A46B 13/00*** | (2006.01) |
| ***A46B 15/00*** | (2006.01) |
| ***A47K 7/04*** | (2006.01) |
| ***A45D 34/04*** | (2006.01) |

(52) U.S. Cl.

CPC ..... *A46B 15/001* (2013.01); *A47K 7/043* (2013.01); *A61H 7/005* (2013.01); *A45D 2200/1054* (2013.01); *A45D 2200/1063* (2013.01); *A46B 15/0038* (2013.01); *A46B 2200/102* (2013.01); *A46B 2200/104* (2013.01); *A46B 2200/1006* (2013.01); *A61H 2201/1215* (2013.01); *A61H 2201/1463* (2013.01); *A61H 2201/1671* (2013.01); *A61H 2205/022* (2013.01)

(56) References Cited

U.S. PATENT DOCUMENTS

| | | | | | |
|---|---|---|---|---|---|
| 4,724,563 | A * | 2/1988 | Fry | A46B 13/02 | 15/28 |
| 4,964,398 | A * | 10/1990 | Jones | A61H 7/005 | 15/22.1 |
| 6,000,083 | A * | 12/1999 | Blaustein | A61C 17/3436 | 15/22.1 |
| 7,165,285 | B1 * | 1/2007 | Hajianpour | A45D 34/041 | 15/22.1 |
| 7,384,377 | B2 | 6/2008 | Berman | | |
| 7,469,703 | B2 * | 12/2008 | France | A46B 9/00 | 134/25.2 |
| 8,484,788 | B2 * | 7/2013 | Brewer | A46B 9/06 | 15/22.1 |
| 8,966,710 | B1 * | 3/2015 | Lozano | A46B 13/02 | 15/23 |
| 2006/0130335 | A1 * | 6/2006 | Suen | A45D 26/0004 | 30/34.05 |
| 2012/0037184 | A1 * | 2/2012 | Czetty | A61Q 19/10 | 134/6 |

FOREIGN PATENT DOCUMENTS

| | | | |
|---|---|---|---|
| KR | 10-2010-0023798 | A | 3/2010 |
| KR | 10-1056507 | B1 | 8/2011 |
| WO | 97/29664 | * | 8/1997 |
| WO | 01/52696 | * | 7/2001 |

* cited by examiner

HAIRDRESSING DEVICE HAVING GEAR MODULE FOR REDUCING ROTATIONAL SPEED

BACKGROUND OF THE INVENTION

1. Field of the Invention

The present invention relates to a hairdressing device having a gear module for reducing rotational speed, and more particularly to a hairdressing device having a gear module for reducing rotational speed in which a speed reducing gear module is connected between a rotary motor and a brush plate such that rotational speed of the brush plate can be adjusted according to gear ratio of the speed reducing gear module.

2. Description of the Related Art

In general, makeup is called actions of cleaning and/or beautifying human body by making a face up with applying rouge and/or powder and tidying makeup to decollate a user's face. Makeup makes a beautiful spot to stand out and modifies and/or disguises shortcomings and ugly spots, but becomes a main reason of bring out skin troubles. Thus, to prevent skin troubles, it is important to remove makeup as well as to makeup.

A general method of removing makeup is to stick water to skin after receiving a proper amount of water, and to scrub skin with hands. However, according to a face washing method of removing makeup by scrubbing skin with hands, makeup cannot be easily removed in the case of a special makeup. That is, it takes much time to completely remove cosmetics from skin by scrubbing kin with hand in the case of waterproofed cosmetics, a sunscreen agent, or a color makeup. Further, according to the method of removing makeup by scrubbing skin with hands, foreign substances attached to hair follicles of skin cannot be effectively removed. An auxiliary tool for removing makeup may be utilized to solve the above-described problem, and a brush is a representative auxiliary tool for removing makeup.

An example of the technology of a cosmetic brush is disclosed in Korean Utility Model Laid-Open No. 20-2011-0004072 (published on Apr. 27, 2011 and entitled Face Washing Brush).

The face washing brush according to the related art includes a knob a surface of which is cut and having at least one groove, and hair fixed to one end of the knob, and the knob is formed of a glossy metal material such as aluminum or nickel. Because the brush has an appealing external appearance without decoration of jewelry, purchase demands and usage demands of a user may be stimulated, and because the brush does not have a jewelry decoration, manufacturing costs can be inexpensive. The cosmetic brush according to the related art may have a good in-use feeling and nano-hair may be used, so that bodily wastes in hair follicles can be clearly removed because natural fiber such as wool is used.

However, the face washing brush according to the related art is formed of natural fiber so that skin troubles can be prevented, but because cosmetics applied to skin should be removed by directly gripping a brush and applying a force, it is inconvenient to use the face washing brush. Furthermore, according to the face washing brush according to the related art, it is difficult to massage skin coated with cosmetics while cosmetics are removed.

BRIEF SUMMARY OF THE INVENTION

The present invention has been made to overcome the above problem and provide a makeup device having a gear module for reducing rotational speed in which a rotary motor is connected to a brush plate on which a brush is mounted such that cosmetics applied on skin such as a face may be removed whenever a user does not directly apply a force.

The present also provides a makeup device having a gear module for reducing rotational speed in which waves are applied to ends of a brush in contact with skin such that the skin may be massaged while a user removes cosmetics from the skin on which the cosmetics are applied using rotation of the brush.

In order to achieve the foregoing and/or other aspects of the present invention, there is provided a makeup device including: a case module including a first case and a second case detachably attached to the first case; a power supply provided in the case module; a rotary motor electrically connected to the power supply and provided in the case module; a gear module connected to a driving shaft of the rotary shaft to reduce rotational speed of the rotary motor; a brush plate exposed out of the first case and reduced to rotate by a gear ratio of the rear module and mounted with a brush; and a controller positioned in the case module and controlling rotational speed of the brush plate according to an operation of the switch.

Here, the gear module is provided in a gear module cover positioned in the case module and a housing cover to cover the gear module cover, and wherein the gear module cover includes: a gear housing; and a switch mount extending from the gear housing and having a switch mount on which the switch is mounted.

The gear module penetrates a gear fixing unit positioned in the housing cover, the housing cover, and a head of the first case and connected to the brush plate.

The brush is coated with material reacting with air and changing in color as time goes by or reacting cosmetics and changing color to indicate a replacement period.

The brush is made of polybutylene terephthalate (PBT), nylon, polyester velvet, and urethane film.

A surface of the brush plate on which the brush is mounted is curved to have a trough and a crest and a plurality of brush filaments provided in the brush has the same length.

The brush includes a plurality of brush filaments, while each of the brush filaments is gradually thinner as runs from a side of the brush plate on which the brush to an end or is rounded at the end.

As described above, according to the makeup device having a gear module for reducing rotational speed in accordance with the present invention, the rotary motor is connected to the brush plate on which the brush is mounted so that a user may remove cosmetics from skin such as a face on which the cosmetics are applied even when a user does not directly a force.

Moreover, according to the makeup device having a gear module for reducing rotational speed in accordance with the present invention, waves are applied to ends of a brush in contact with skin such that the skin may be massaged while a user removes cosmetics from the skin on which the cosmetics are applied using rotation of the brush.

DETAILED DESCRIPTION OF THE INVENTION

The above aspects and features of the present invention will be more clear through following detailed description and the accompanying drawings.

Hereinafter, a makeup device having a gear module for reducing rotational speed according to an embodiment of the present invention will be described in detail with reference to FIGS. 1 to 5C.

Figure 1:
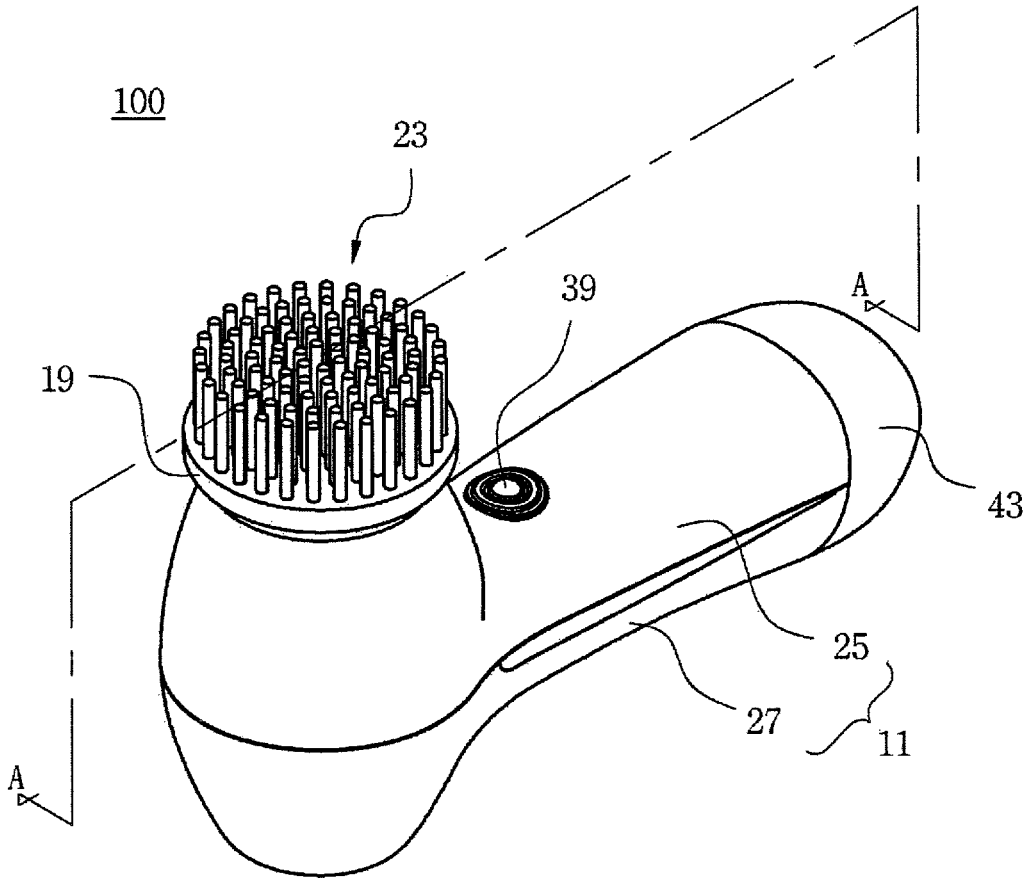
FIG. 1 is a perspective view illustrating an outer appearance of a makeup device having a gear module for reducing rotational speed according to an embodiment of the present invention.
Figure 2:
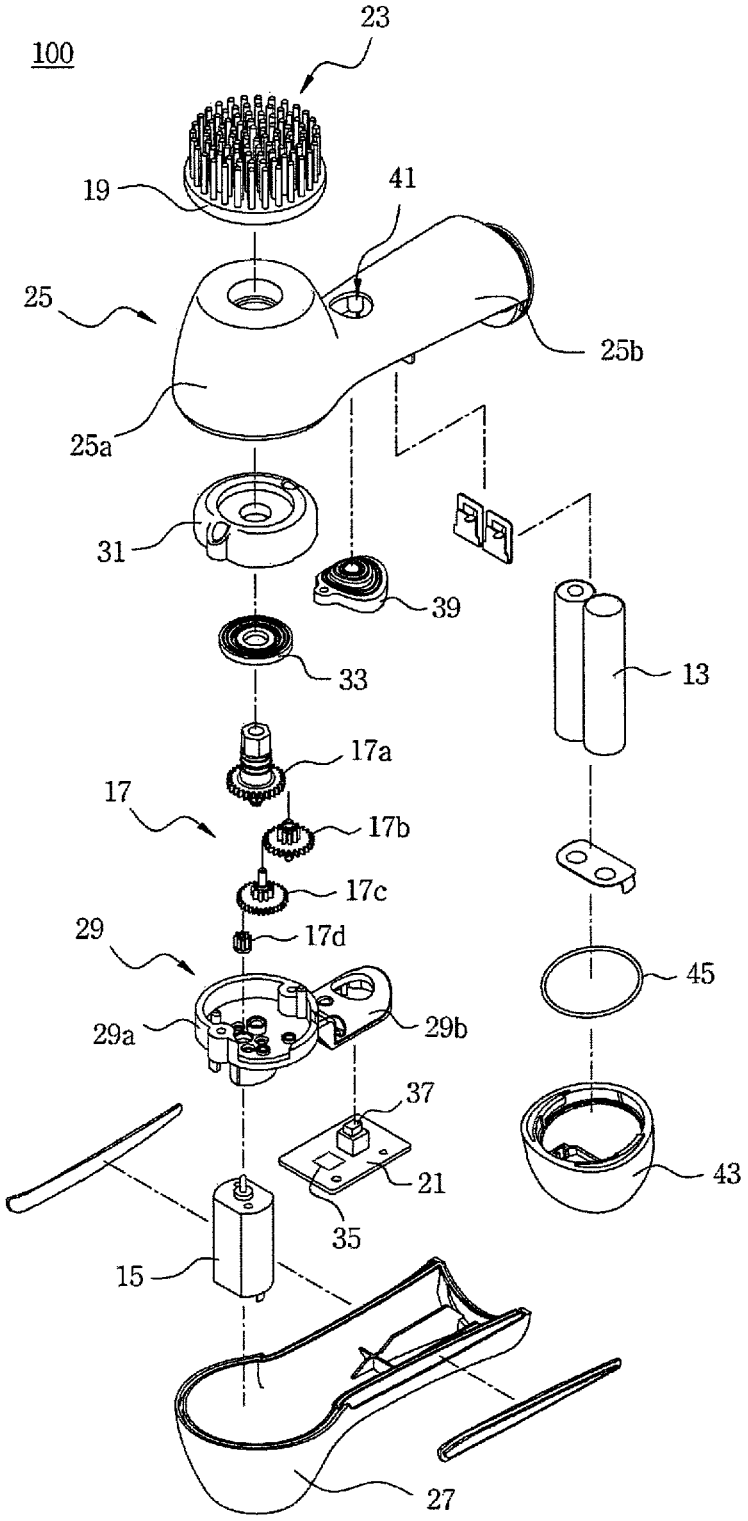
FIG. 2 is an exploded perspective view illustrating an outer appearance of a makeup device according to an embodiment of the present invention.
Figure 3:
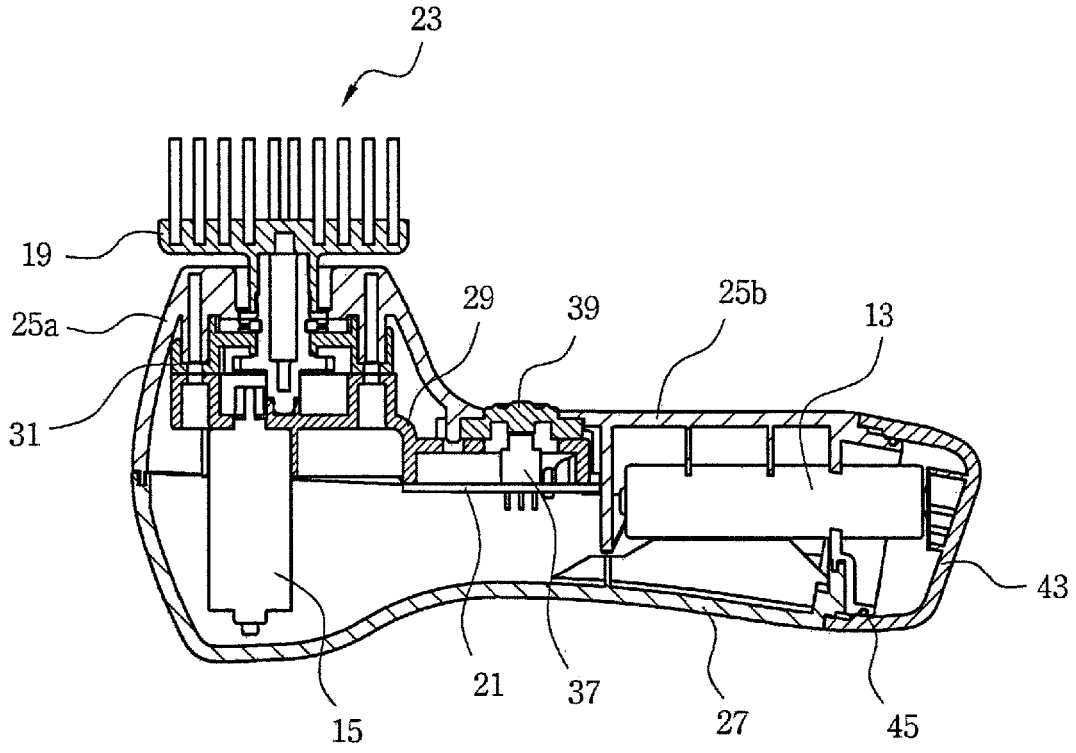
FIG. 3 is a sectional view taken along the line A-A' of FIG. 1.
Figure 4:
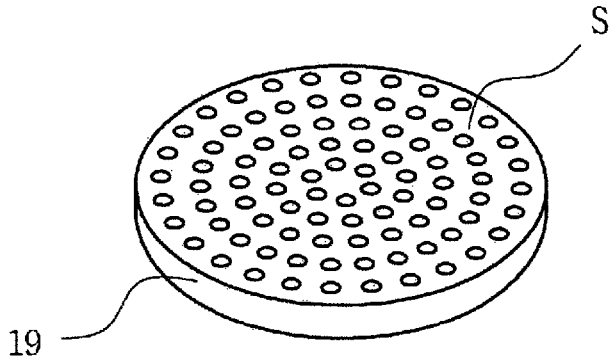
FIG. 4 is a perspective view illustrating a brush plate employed in the makeup device according to an embodiment of the present invention.
Figure 5A:
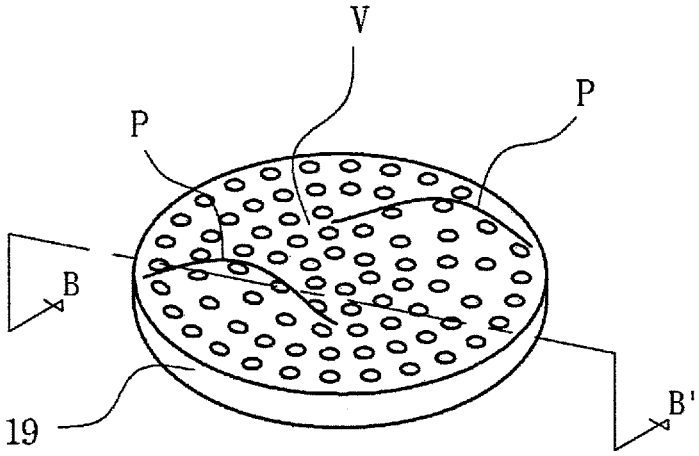
FIG. 5A is a perspective view illustrating a brush plate employed in another embodiment of the present invention.
Figure 5B:
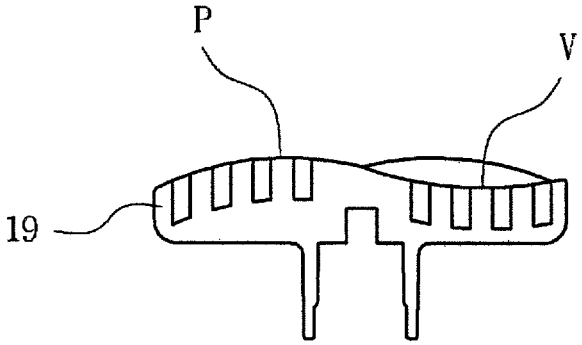
FIG. 5B is a sectional view taken along the line B-B' of FIG. 5A.
Figure 5C:
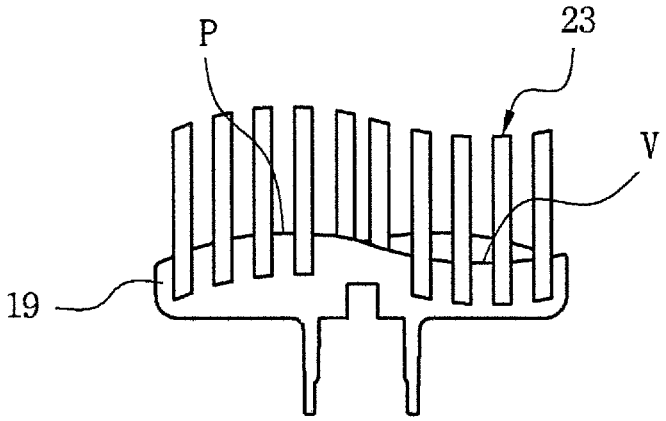
FIG. 5C is a perspective view illustrating a brush is mounted on the brush plate as shown in FIG. 5B.

FIG. 1 is a perspective view illustrating an outer appearance of a makeup device having a gear module for reducing rotational speed according to an embodiment of the present invention, FIG. 2 is an exploded perspective view illustrating an outer appearance of a makeup device according to an embodiment of the present invention, FIG. 3 is a sectional view taken along the line A-A' of FIG. 1, FIG. 4 is a perspective view illustrating a brush plate employed in the makeup device according to an embodiment of the present invention, FIG. 5A is a perspective view illustrating a brush plate employed in another embodiment of the present invention, FIG. 5B is a sectional view taken along the line B-B' of FIG. 5A, and FIG. 5C is a perspective view illustrating a brush is mounted on the brush plate as shown in FIG. 5B.

Referring to FIGS. 1 to 3, a makeup device 100 according to an embodiment of the present invention includes a case module 11, a power supply 13, a rotary motor 15, a gear module 17, a brush plate 19, and a printed circuit board 21. The makeup device 100 is used to rotate the brush plate 19 connected to the rotary motor 15 to remove cosmetics applied on skin, particularly on a face. The makeup device 100 may remove lotion, waterproof cosmetics, sunblock, and color cosmetics. Moreover, the makeup device 100 may remove cosmetics applied to a curved spots effectively by varying shapes of the brush 23 mounted on the brush plate 19 and may massage simultaneously with removal of cosmetics.

The case module 11 includes a first case 25 and a second case 27 detachably attached to the first case 25. The first case 25 and the second case 27 are coupled with each other to provide a space for installing the power supply 13, the rotary motor 15, the gear module 17, and the printed circuit board 21. The first case 25 includes a head 25*a* to which the brush plate 19 is mounted and a body 25*b* extending from the head 25*a* easily griped by a used.

The head 25*a* is provided with the rotary motor 15 and the gear module 17 which are positioned therein. The rotary motor 15 drives a rotary shaft with an electric power applied from the power supply 13 positioned in the body 25*b*. The rotary motor 15 may be one employed from any type of motors to rotate the brush plate 19 connected to the rotary shaft in a direction or both directions.

The power supply 13 may be a commercial power supply to supply an electric power to the rotary motor 15 using a primary battery or a secondary battery or electric wires. An electric circuit of the power supply 13 is well known to an ordinary skill in the art and the detailed description thereof will be omitted.

The gear module 17 is mounted in a gear module cover 29 and a housing cover 31 that are positioned in the head 25*a* of the first case 25 and the second case 27. The gear module cover 29 is mounted on the rotary motor 15 positioned between an inner wall of the second case 27 and the gear module cover 29 in the case module 11. The gear module cover 29 includes a gear housing 29*a* and a switch mount 29*b* extending from the gear housing 29*a*. The gear housing 29*a* encases the gear module 17 in association with the housing cover 31 positioned adjacent to the head 25*a*.

The gear module 17 is connected to the rotary shaft of the rotary motor 15 penetrating the gear housing 29*a*. The gear module 17 transmits rotations of the rotary shaft to the brush plate 19 using a gear ratio between a plurality of gears 17*a* to 17*d*. The gears 17*a* to 17*d* may be called a first gear 17*a*, a second gear 17*b*, a third gear 17*c*, and a fourth gear 17*dd* sequentially. The reduction of rotations of the rotary shaft using the gears 17*a* to 17*d* is well known to ordinary sill in the art and its detailed description will be omitted.

The gear module 17 is fixed by a gear fixing unit 33 positioned in the housing cover 31 and penetrates the housing covering 31 and the head 25*a* of the first case 25 for the connection with the brush plate 19. Thus, the brush plate 19 may rotate at a rotational speed reduced by the gear ratios between the gears 17*a* to 17*d* provided in the gear module 17.

Meanwhile, the printed circuit board 21 is positioned between the switch mount 29*b* extending from the gear housing 29*a* and an inner side of the second case 27. The printed circuit board 21 includes a controller 35 controlling rotation of the rotary shaft of the rotary motor 15 and is mounted with a switch 37. The switch 37 switches on/off an electric power applied to the rotary motor 15 from the power supply 13 adjusts rotational speed of the rotary shaft of the rotary motor 15 under the control of the controller 35 . The switch 37 penetrates the switch mount 29*b* and is encased by the switch cover 39. The switch cover 39 penetrates a switch hole 41 formed in the body 25*b* of the first case 25 and is exposed out of the first case 25. Thus, a user may grip the body 25*b* and press the switch cover 39 exposed over the switch hole 41 to manipulate the switch 37.

A case stopper 43 is mounted at an end of the body 25*b* to replace the power supply or to take it out for the charging. The case stopper 43 may be detachably attached to the case module 11 in a well-known way, for example, a screw-fitting. In this case, a packing 45 may be mounted in the case stopper 43 to prevent a liquid or steam from entering into the power supply 13.

Referring to FIGS. 2 and 4, the brush plate 19 employed in the makeup device 100 according to an embodiment of the present invention includes a brush 23 having a plurality of brush filaments. The brush 23 may be coated with material reacting with air and changing color as time goes by or material reacting with cosmetics and changing color as time goes by so that a replacement period of the brush 23 may be indicated.

For example, the coated material is coated to confirm the replacement period when more than once a day for three months are used, changes colors as time goes by or by the continuous use, or becomes thin in color as cosmetics is dissolved and its concentration is thinner. Moreover, the coated material may be eatable dye with guaranteed safety for the safe of skin. In this case, color of the coated material may be different from original color of the brush filaments, such as blue, green, orange color, yellow, wine color, or purple color, and the coated material may be coated partially on ends of the brush filaments or throughout the brush filaments to appear a color.

The brush 23 may be made of polybutylene terephthalate (PBT), nylon, polyester velvet, or urethane film. In a case when the brush 23 is made of PBT, the brush filaments may be 0.07 mm to 0.13 mm thick and 8 mm to 14 mm long. In this case, the brush filaments may be gradually thinner as runs to ends thereof to easily remove body waste from pores during the touch of the brush filaments with the skin and to improve a soft feeling of skin.

For example, the brush filaments may be planted in the brush plate 19 by unit of 11 mm to 13 mm. In this case, the brush filaments may be 96 micrometers to 100 micrometers thick on a first surface S of the brush plate 19 and 6 micrometers to 10 micrometers long at a position spaced apart by 0.1 mm from ends of the brush filaments. Moreover, the brush filaments may be gradually thinner to about 0.01 mm thickness with a gentle slope from a bottom spaced apart by 2 mm to 3 mm from ends of the brush filaments for maintenance of elasticity of the brush filaments.

Brush filaments may be planted in holes of 1.5 mm to 1.6 mm of the first surface S of the brush plate 19 and may be provided on the first surface S within a range of 100 to 200 filaments. In a case when the brush filaments are thinner than 0.07 mm, for example, 0.04 mm to 0.06 mm thick, more than 200 filaments may be planted in the first surface S. The brush 23 may be coated with a material having color change as time goes by and an anti-virus material.

When the brush 23 is made of polyester velvet, the brush filaments are woven in the form of velvet having 108 filaments, 144 filaments, or 288 filaments of fabric with thickness of 3 micrometer s and may be 2 mm to 3 mm long. The brush filaments may generate compact, adhesive, and strong bubbles when being used with cleansing products.

The first surface S of the brush plate 19 on which the brush 23 is mounted is flat or curved. In a case when the first surface S is flat, the brush 23 may be parallel to the first surface S or curved to perform a massage function. For example, the respective brush filaments may be same in length to be parallel to the first face S or be planted in different lengths to have the massage function.

On the other hand, as illustrated in FIGS. 5A to 5C, surface of the brush plate 19 on which the brush 23 is mounted may have troughs V and crest P. the brush filaments are same in length, the ends of the filaments may be curved to have the massage function. Thus, the makeup device 100 may use the brush plate 19 having a curved surface formed by the ends of the brush filaments so that the brush plate 19 may be rotated to remove cosmetics coated on skin and massage the skin.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

Description of Reference Numerals for Main Components of the Drawings

| | | | |
|---|---|---|---|
| 11: | case module | 13: | power supply |
| 15: | rotary motor | 17: | gear module |
| 19: | brush plate | 21: | printed circuit board |
| 23: | brush gear | 25: | first case |
| 25a: | head | 25b: | body |
| 27: | second case | 29: | gear module cover |
| 29a: | gear housing | 29b: | switch mount |
| 31: | housing cover | 33: | gear fixing unit |
| 35: | controller | 37: | switch |
| 39: | switch cover | 41: | switch hole |
| 43: | case stopper | 45: | packing |
| 100: | makeup device | | |

What is claimed is:

1. A makeup device comprising:

a case module including a first case and a second case detachably attached to the first case;

a power supply provided in the case module;

a rotary motor electrically connected to the power supply and provided in the case module;

a gear module connected to a driving shaft of the rotary motor to reduce rotational speed of the rotary motor;

a brush plate exposed out of the first case and reduced to rotate by a gear ratio of the gear module and mounted with a brush; and a controller positioned in the case module and controlling rotational speed of the brush plate according to an operation of a switch, wherein the gear module is provided in a gear module cover positioned in the case module and a housing cover to cover the gear module cover, wherein the gear module cover comprises:

a gear housing; and a switch mount extending from the gear housing and having a switch mount on which the switch is mounted.

2. The makeup device of claim 1, wherein the gear module penetrates a gear fixing unit positioned in the housing cover the housing cover, and a head of the first case and connected to the brush plate.

3. The makeup device of claim 1, wherein the brush is coated with material reacting with air and changing in color as time goes by or reacting with cosmetics and changing color to indicate a replacement period.

4. The makeup device of claim 1, wherein the brush is made of one of polybutylene terephthalate (PBT), nylon, polyester velvet, and urethane film.

5. The makeup device of claim 1, wherein a surface of the brush plate on which the brush is mounted is curved to have a trough and a crest and a plurality of brush filaments provided in the brush has the same length.

6. The makeup device of claim 1, wherein the brush includes a plurality of brush filaments, wherein the brush filaments taper from the brush plate to their ends of the brush filaments or ends of the brush filaments are rounded.

* * * * *